US005785558A

United States Patent [19]

Post et al.

[11] Patent Number: 5,785,558

[45] Date of Patent: Jul. 28, 1998

[54] ELECTRICAL CONNECTOR ASSEMBLY

[75] Inventors: Lothar Andreas Post, Offenbach; Dieter Lietz, Frankfurt; Jörg Kunze, Rüsselsheim; Lukas Pniak-Pawlik, Frankfurt, all of Germany; Jean-Pierre Picaud, Eaubonne; Thierry Mezin, Houilles, both of France

[73] Assignee: The Whitaker Corporation, Wilmington, Del.

[21] Appl. No.: 745,195

[22] Filed: Nov. 7, 1996

[30] Foreign Application Priority Data

Nov. 21, 1995 [DE] Germany ..... 195 43 423.4
Sep. 30, 1996 [EP] European Pat. Off. ..... 96402085

[51] Int. Cl.[6] ..... H01R 13/502

[52] U.S. Cl. ..... 439/680; 439/686

[58] Field of Search ..... 439/680, 681, 439/686, 695

[56] References Cited

U.S. PATENT DOCUMENTS

| | | | |
|---|---|---|---|
| 4,726,791 | 2/1988 | Ruda, Jr. et al. | 439/677 |
| 4,813,892 | 3/1989 | Strate | 439/681 |
| 5,044,994 | 9/1991 | Van Woensel | 439/681 |
| 5,370,556 | 12/1994 | Olsson | 439/681 |
| 5,460,548 | 10/1995 | Roth | 439/680 |
| 5,564,935 | 10/1996 | Yagi et al. | 439/157 |
| 5,584,721 | 12/1996 | Taniuchi et al. | 439/374 |

FOREIGN PATENT DOCUMENTS

| | | |
|---|---|---|
| UM 8715118.9 | 4/1989 | Germany . |
| 37 38 593 A1 | 5/1989 | Germany . |
| WO 93/17470 | 9/1993 | Germany . |

*Primary Examiner*—Gary F. Paumen

[57] ABSTRACT

A connector assembly having a trough-shaped accommodating part and a plug part which can be plugged into the latter where the plug part has an essentially rectangular cross-section and in the vicinity of the two end edges, a safety rib extends in the plugging direction outward therefrom in such a way that the width the respectively opposite safety ribs is greater than the width of the basic plug part and the accommodating part has a plug channel with safety grooves for accommodating the safety ribs in the longitudinal side walls such that the plug part is receivable therein, the plug part having a surrounding housing and a socket housing that can be telescopically pushed into the surrounding housing through an insertion opening on a transverse side surface and complementary latching structure is provided on the surrounding housing and on the socket housing, for the purpose of latching the socket housing in the surrounding housing where the safety ribs are fitted to the socket housing or the surrounding housing on the side with the insertion opening.

5 Claims, 6 Drawing Sheets

ELECTRICAL CONNECTOR ASSEMBLY

BACKGROUND OF THE INVENTION

1. Field of the Invention

The invention relates to an electrical connector assembly, consisting of a trough-shaped accommodating part and a plug part which can be plugged into the latter 2. Description of the Prior Art It is known to provide such connectors with the following additional features:

- the accommodating part has an elongate plug receiving channel which is bounded by relatively long longitudinal side walls and relatively short transverse side walls,
- the plug part has an essentially rectangular cross-section with longitudinal side surfaces and transverse side surfaces,
- the socket housing can be pushed into the surrounding housing through an insertion opening on a transverse side surface,
- in the vicinity of the two end edges, a safety rib extending in the plugging direction is in each case situated on each longitudinal side surface of the plug part, in such a way that the width of the plug part with the respectively opposite safety ribs is greater than the central width of the plug channel,
- complementary safety grooves for accommodating the safety ribs are in each case formed in the longitudinal side walls of the accommodating part,
- the plug part consists of a surrounding housing and a socket housing.

U.S. Pat. No. 5,460,548, incorporated herein by reference for all purposes, discloses a connector of the generic type. From this publication, it is known to furnish the plug part of the connector with safety ribs. A socket housing can be introduced into the plug part through an insertion opening. In order to secure the socket housing, the surrounding housing can be closed off, for example, by a plugged-on closure plate. It is further known from this publication that the safety ribs can be integrally formed on the plugged-on closure plate. A disadvantage of this arrangement is that it is possible to couple the accommodating part and plug part when the safety plate is not pushed on and the socket housing is not in its end position. This can result in damage to the pins in the accommodating part. Another disadvantage is provision of the closure plate for securing the socket housing. It is a small part that can easily be lost or incorrectly mounted, and also increases the volume of the connector. Manufacturing and handling costs are increased, whilst reliability is decreased. It would be desirable to provide a simpler, more reliable and more compact connector without requiring a reduction in functionality.

SUMMARY OF THE INVENTION

The object of the invention is to provide a connector which ensures that the socket housing is secured in the plug part in a simple and reliable manner.

It would be further advantageous to provide the plug part with means cooperating with the accommodating part to prevent damage to contacts, and ensure correct coupling.

Objects of the invention are achieved by providing a connector assembly comprising a trough-shaped accommodating part and a plug part which can be plugged into the latter, having the following features:

- the accommodating part has an elongate plug channel which is bounded by relatively long longitudinal side walls and relatively short transverse side walls,
- the plug part has an essentially rectangular cross-section with longitudinal side surfaces and transverse side surfaces,
- the plug part consists of a surrounding housing and a socket housing,
- the socket housing can be pushed into the surrounding housing through an insertion opening on a transverse side surface,
- latching means are provided on the surrounding housing and on the socket housing, for the purpose of latching the socket housing in the surrounding housing, It is advantageous that the socket housing can be latched in the surrounding housing of the plug part without need for a separate cover in a cost-effective and reliable manner.

Further advantageous features are:

- in the vicinity of the two end edges, a safety rib extending in the plugging direction is in each case situated on each longitudinal side surface of the plug part, in such a way that the width of the plug part with the respectively opposite safety ribs is greater than the central width of the plug channel,
- complementary safety grooves for accommodating the safety ribs are in each case formed in the longitudinal side walls of the accommodating part, and
- the safety ribs are fitted to the socket housing on the side with the insertion opening.

Other advantageous developments are specified in the subclaims.

It is highly advantageous that, with the aid of the safety ribs which are wider than the central width of the plug channel, the plug part is prevented from being able to be plugged into the accommodating part at an angle, and thus no damage can be inflicted on the pins in the accommodating part.

Since the safety ribs are fitted to the socket housing, the plug part cannot be plugged into the accommodating part if the socket housing has not been completely introduced. Therefore, the arrangement according to the invention ensures that the socket housing must be in its end position before the plugging operation. Moreover, an additional part can be saved.

It is further advantageous that polarity reversal of the plug part in the accommodating part is impossible. This is achieved by virtue of the fact that the safety ribs at the two opposite ends have different widths. For example, they are wider on the socket housing than on the surrounding housing. Having wider safety ribs on the socket housing facilitates the handling of this socket housing.

A further advantageous feature of a particularly cost-effective version, is provision of the latching means on the secondary locking rib of the surrounding housing, which engages with a step or tooth on the housing. As conventional housings already exist with such teeth, which are provided in side walls for engaging complementary secondary locking ribs on the surrounding housing, existing housings can be used for the invention, leading to a particularly cost-effective solution.

DETAILED DESCRIPTION OF THE PREFERRED EMBODIMENT

Figure 1B:
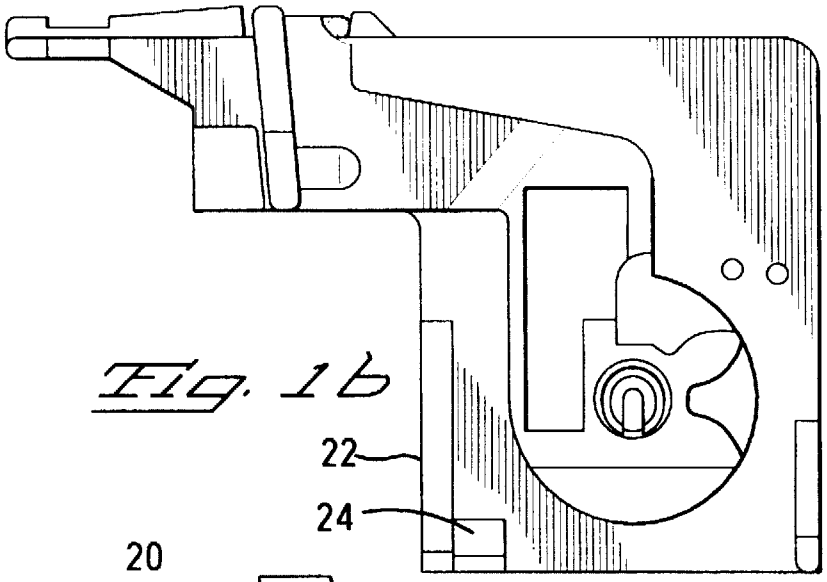
FIG. 1*b* shows a side view of a surrounding housing that receives the socket housing of FIG. 1*a*.
Figure 2B:
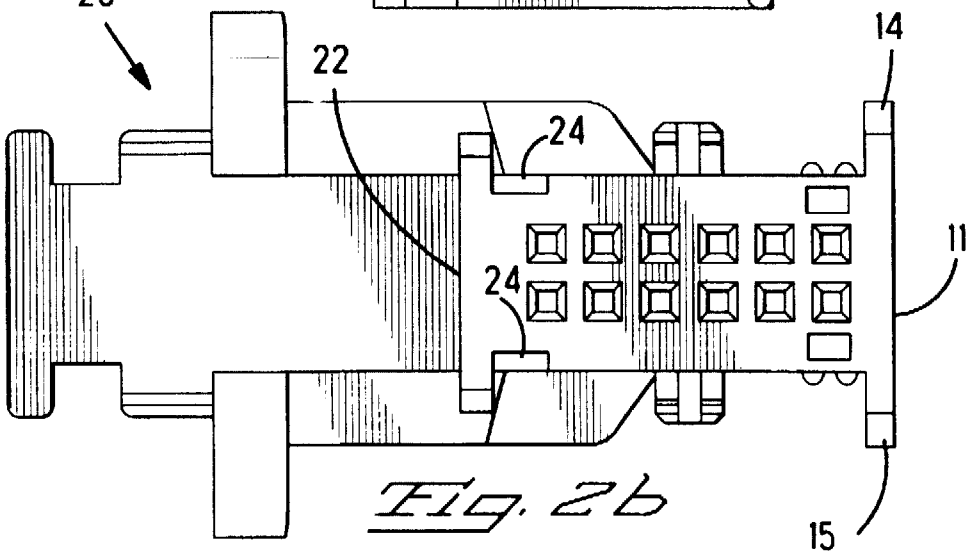
FIG. 2*b* shows a lower view of the surrounding housing of FIG. 1*b*.
Figure 1A:
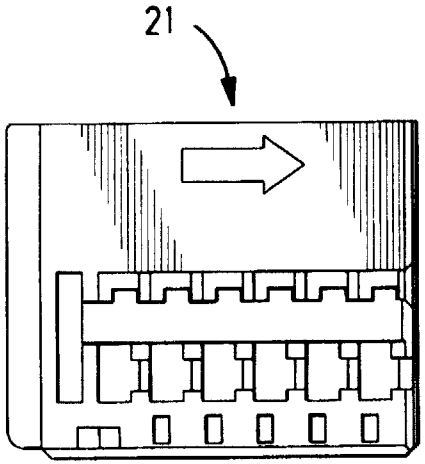
FIG. 1*a* shows a side view of a socket housing of a plug part according to the present invention.
Figure 2A:
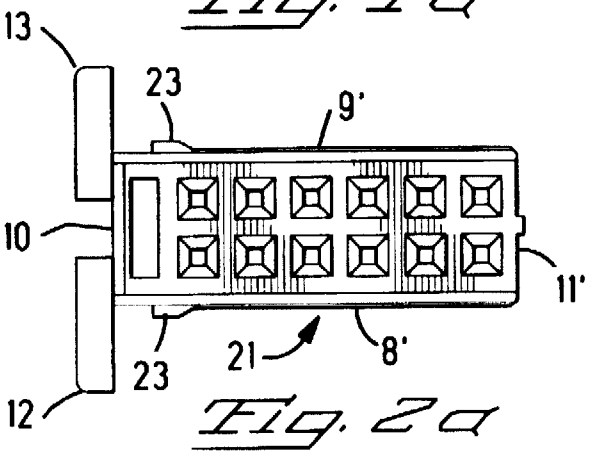
FIG. 2*a* shows a view from underneath the socket housing of FIG. 1*a*.

FIG. 1*a* shows a side view of a socket housing 21. Sockets for accommodating plug pins, which are held in a corresponding accommodating part, are situated in one or more rows in this socket housing 21. The arrow indicates the push-in direction in which the socket housing 21 is inserted into the surrounding housing 20 of the plug part. The socket housing 21 is essentially a rectangular parallelepiped with longitudinal side surfaces 8 and 9 and transverse side surfaces 10 and 11 (see FIG. 2*a*). Latching lugs 23 are provided on the longitudinal side surfaces 8 and 9. In addition, two safety ribs 12 and 13 are provided on the longitudinal side surface, at the end facing the transverse side 10. These safety ribs simultaneously serve as a stop when the socket housing 21 is inserted into the surrounding housing 20 (FIGS. 1*b* and 2*b*). These safety ribs 12 and 13 allow the socket housing to be handled easily.

As illustrated in FIGS. 1*b* and 2*b*, the surrounding housing 20 has an insertion opening 22 on a transverse side. The socket housing 21 can be pushed into the surrounding housing 20 through this insertion opening 22. Furthermore, the surrounding housing 20 has latching openings 24, in which the latching lugs 23 on the socket housing 21 can latch into place when the latter is pushed into the surrounding housing 20. It can also be discerned that safety ribs 14 and 15 are provided at each end on the longitudinal side surfaces of the surrounding housing 20. These safety ribs 14 and 15 and the safety ribs 12 and 13 prevent the plug part 2 from being able to be introduced into the accommodating part at an angle and the pins in the latter from being damaged. This principle is disclosed in U.S. Pat. No. 4,726,791 incorporated herein by reference for all purposes.

If the safety ribs are designed to have different widths, then they can additionally be used as coding ribs. In the arrangement depicted, for example, the safety ribs 12 and 13 are considerably wider than the safety ribs 14 and 15. This prevents the plug from being able to be inserted into the accommodating part in a manner turned through 180°, thereby providing a polarization feature. It can further be discerned that there is provided on the plug part 2 a lever arm having a gearwheel cutout, which would facilitate the joining together of the accommodating part and plug part.

Figure 3:
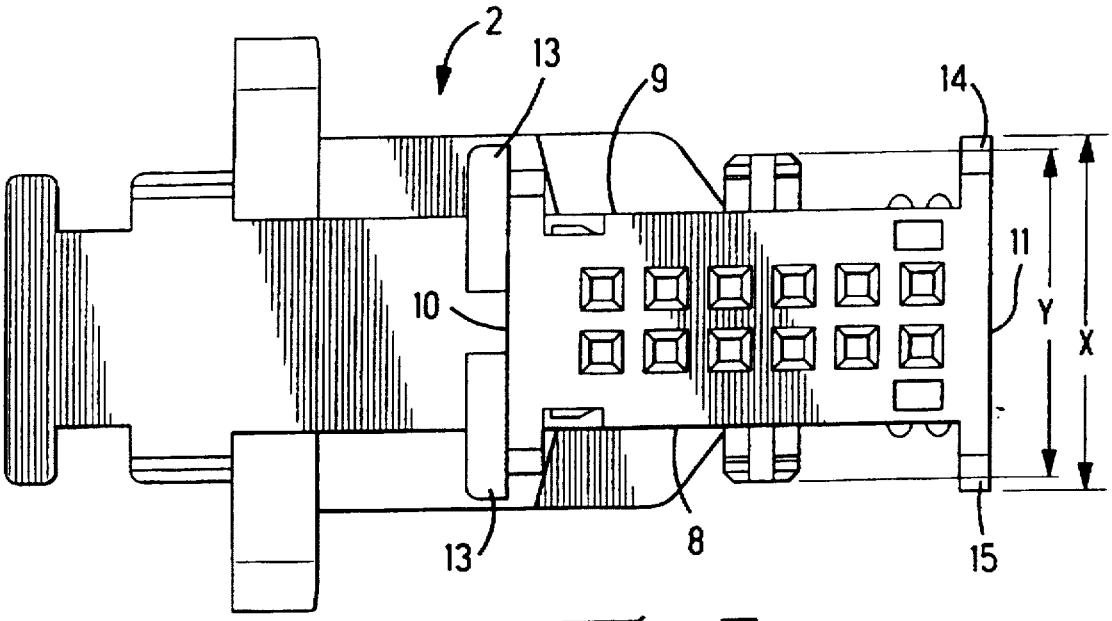
FIG. 3 shows the underside of the assembled plug part with the socket housing having been introduced into the surrounding housing.

FIG. 3 depicts a further view of a plug part 2. In this case, the socket housing 21 is inserted into the surrounding housing 20. The safety ribs 12 to 15, the transverse sides 10 and 11 as well as the longitudinal sides 8 and 9 and the plugged aspect can be clearly seen.

Figure 4:
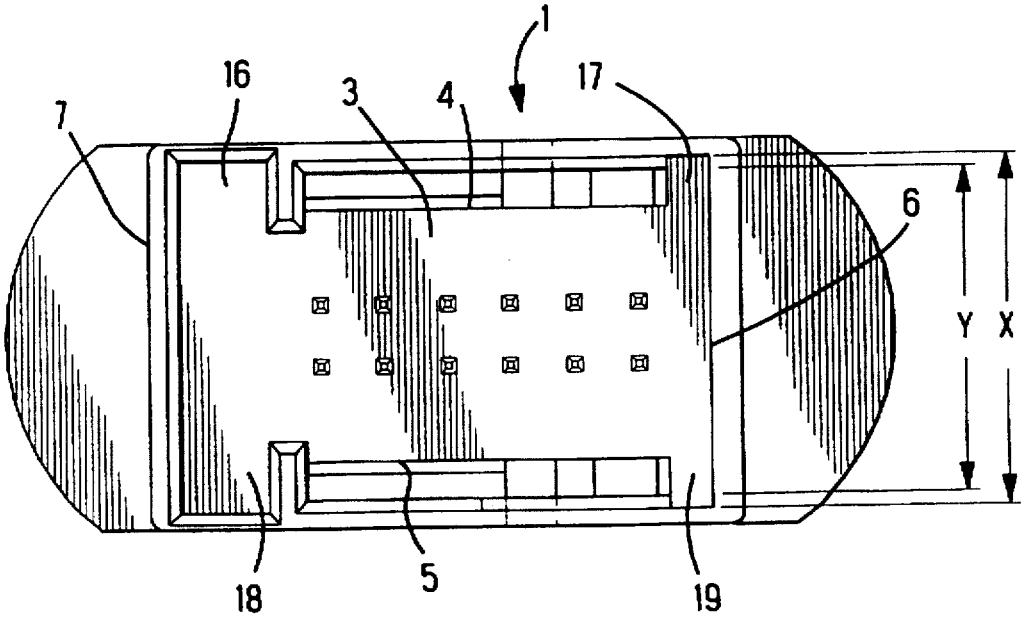
FIG. 4 shows an upper plan view of an accommodating part for receiving the plug part of the present invention.
Figure 5:
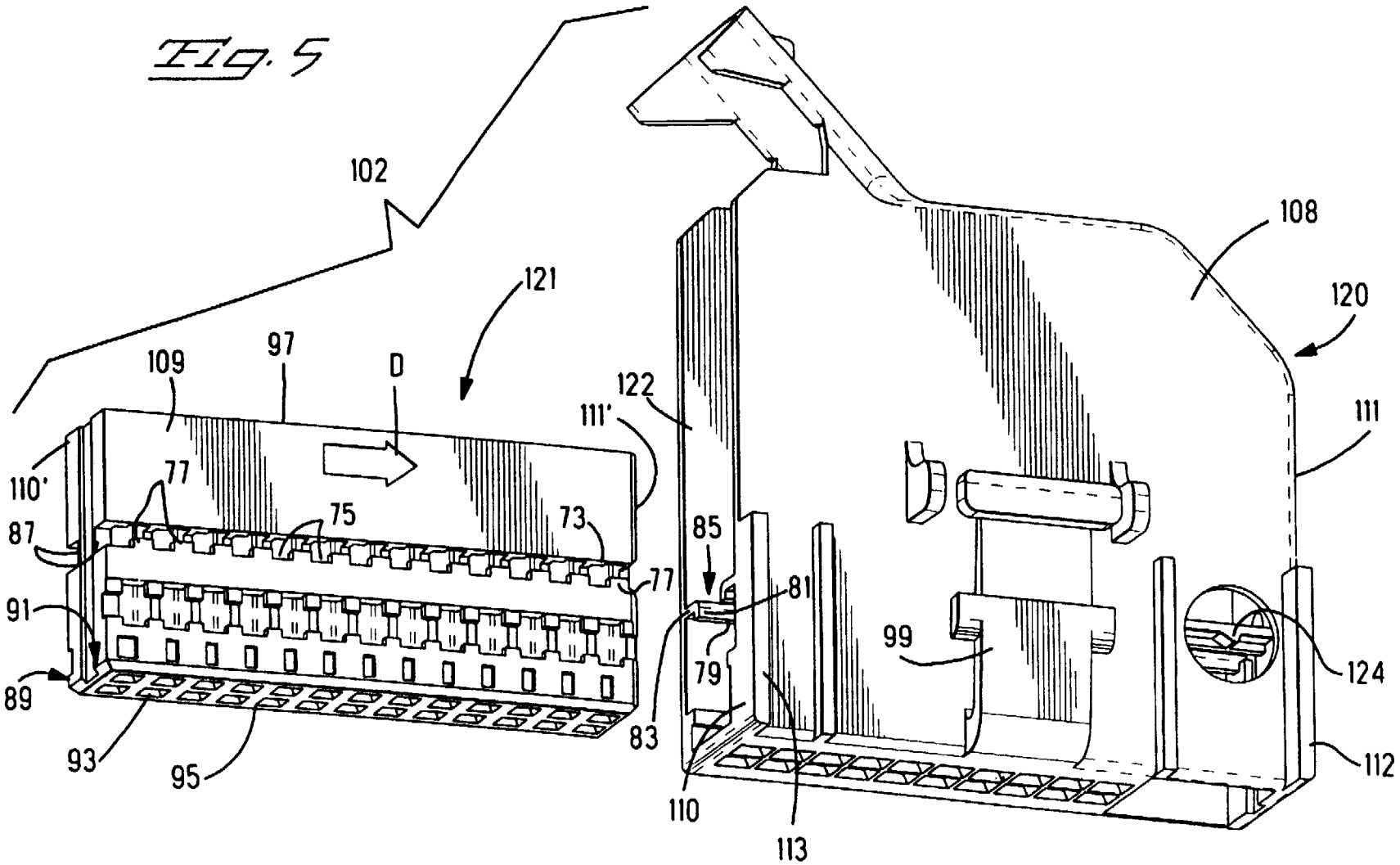
FIG. 5 is an exploded isometric view of another embodiment of the present invention showing the socket housing and surrounding housing about to be assembled together.

FIG. 4 depicts the accommodating part as a pin housing 1. The plug channel 3 having a trough-shaped design can be seen. It has two longitudinal side walls 4 and 5, as well as transverse side walls 6 and 7. Complementary safety grooves 16 to 19 are included that correspond to the safety ribs 12 to 15. The position of the contact pins in the bottom of the channel 3 of this pin housing can clearly be discerned. The central width of the housing is designated by y, while the width of the outer surfaces of the safety ribs is x. It must be ensured that x is greater than y, in order to prevent the pins in the accommodating part from being able to be damaged.

The two opposing side walls 4,5 of the accommodating part 1 comprise a toothed rack each for mating the plug and accommodating parts. When the plug and accommodating parts are mated, the lever arm with the gearwheel cutout will be actuated and the teeth will engage with those of the corresponding toothed rack.

Referring to FIGS. 5–9, another embodiment of a plug part is shown at 102 and is shown comprising a surrounding housing 120 and a socket housing 121 for receiving electrical receptacle terminals therein. The plug part 102 is matable to an accommodating part similar to the accommodating part 1 shown in FIG. 4 except for certain differences in the connector locking mechanism, whereby the plug part 102 is provided with a resilient latching clip 99 that latches with corresponding shoulders in the accommodating part. The surrounding housing 120 is provided with ribs 112,113 that are used for coding and/or guiding of the plug part with respect to the accommodating part. Although ribs are shown only projecting from one side wall 108, the ribs can of course be provided with the same construction as described in the previous embodiment of FIGS. 1–4. The embodiment of FIGS. 5–9 also differs from the previously described embodiment, by the means of securing the socket housing 121 to the surrounding housing 120.

The socket housing 121 as generally shown in FIGS. 5–9 is essentially an existing part comprises an insulative body extending from a terminal receiving end 97 to a mating end 95, bounded by longitudinal side surfaces 109 and end surfaces 110,111. Socket terminal receiving cavities 93 extend from the terminal receiving end 97 through the mating end 97,95 respectively. The cavities 93 are arranged in two rows 91,89 extending in a direction of insertion D of the socket housing 121 into the surrounding housing 120. The housing side walls 109 are penetrated by secondary locking grooves 87 extending in the direction D and traversing the cavities 93 on either side of the housing. The grooves 87 enable access of a secondary locking member in the form of an L-shaped protrusion 85 of the surrounding housing 120 thereinto for engagement behind socket terminals (not shown) mounted in the cavities 93. The L-shaped secondary locking projections 85 extend from and alongside the inside of the surrounding housing side walls 108. Secondary locking of terminals within the cavities 93 thus occurs when the socket housing 121 is slid (mounted)in the direction D into the surrounding housing 120, whereby the L-shaped members 85 slide into the L-shaped grooves 87. The L-shaped secondary locking projection comprises a first horizontal portion 83 and a second vertical portion 81 providing the secondary locking shoulder 79 at a lower free end. The vertical portion 81 engages behind a plurality of wall portions or teeth 77 that bound the socket housing grooves 87 at the side surface 109. The wall portions 77 cooperate with the secondary locking member portion 81 in order to hold the surrounding housing side wall 108 securely against the socket housing side walls 109. The wall portions 77 are separated by recesses 75 that facilitate the moulding procedure of the socket housing, thereby forming teeth.

The surrounding housing 120 is provided with an end wall 111 (or transverse side wall) at one end and an open face 110 at the other end for receiving the socket housing 121 therein. Proximate the closed end 111, latching protrusions 124 are provided on the secondary locking protrusions 85. The latching protrusions 124 are provided on the first or horizontal extension 83 for engaging behind a shoulder 73 of the first wall portion 77 proximate the end 111' of the socket housing 121. The latching protrusions 124 thus provide a very simple means of securing the socket housing 121 in the surrounding housing 120. The latter solution is very cost-effective as the module housings 121 already exist in various configurations and are provided with the recesses 75 between wall portions (teeth) 77 for reasons of simplifying the injection moulding thereof. Only provision of the simple latching protrusions 124 on the secondary locking projection 85 is thus needed for a cost-effective and particularly compact securing means.

Figure 6:
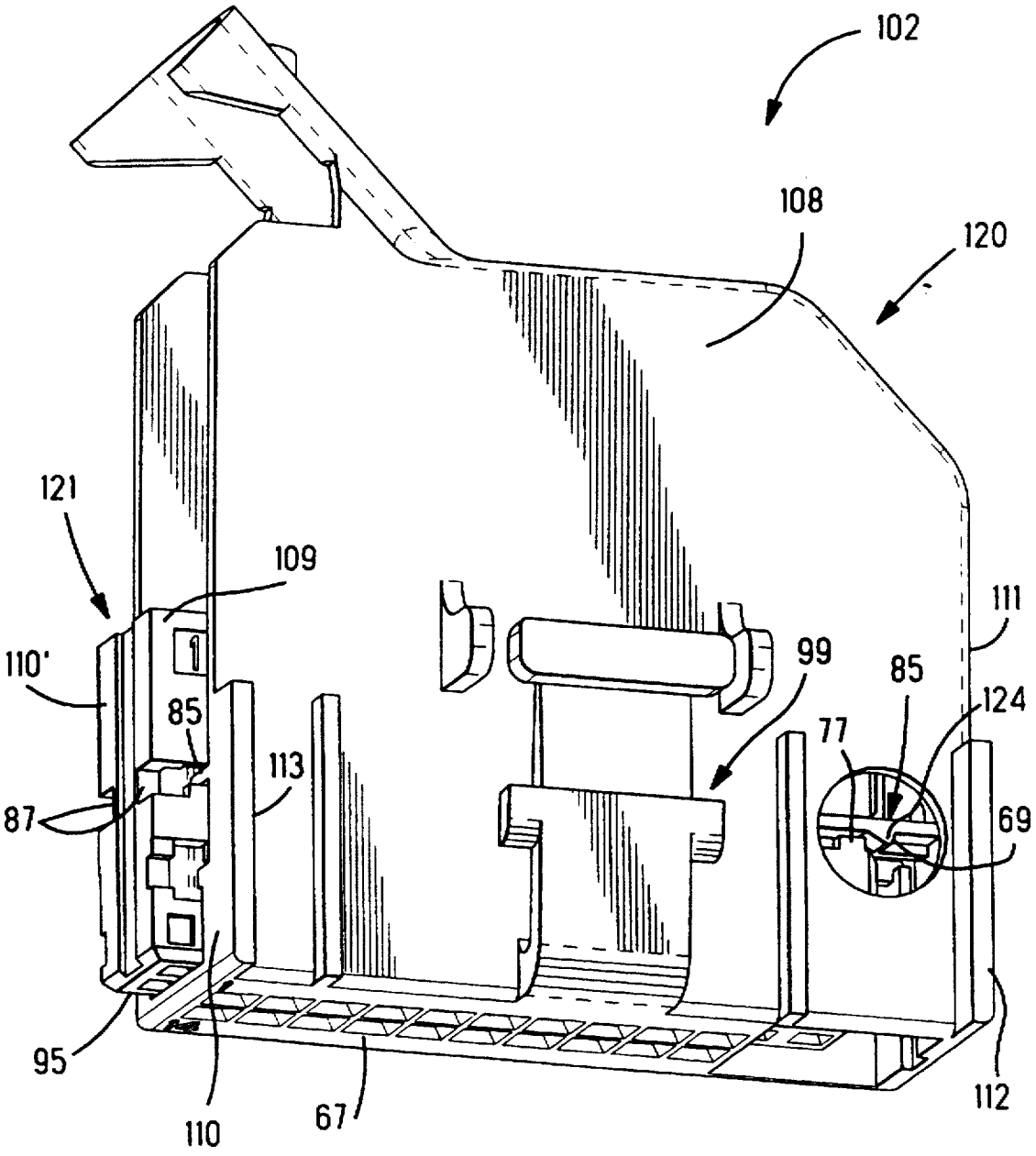
FIG. 6 is a view similar to that of FIG. 5 but with the socket and surrounding housings partially assembled.

FIG. 6 shows the socket housing 121 almost fully inserted into the surrounding housing 120 whereby the latching protrusion 124 is about to engage the first wall portion 77 as the socket housing end 111' is brought towards the surrounding housing 120 end 111.

Figure 7:
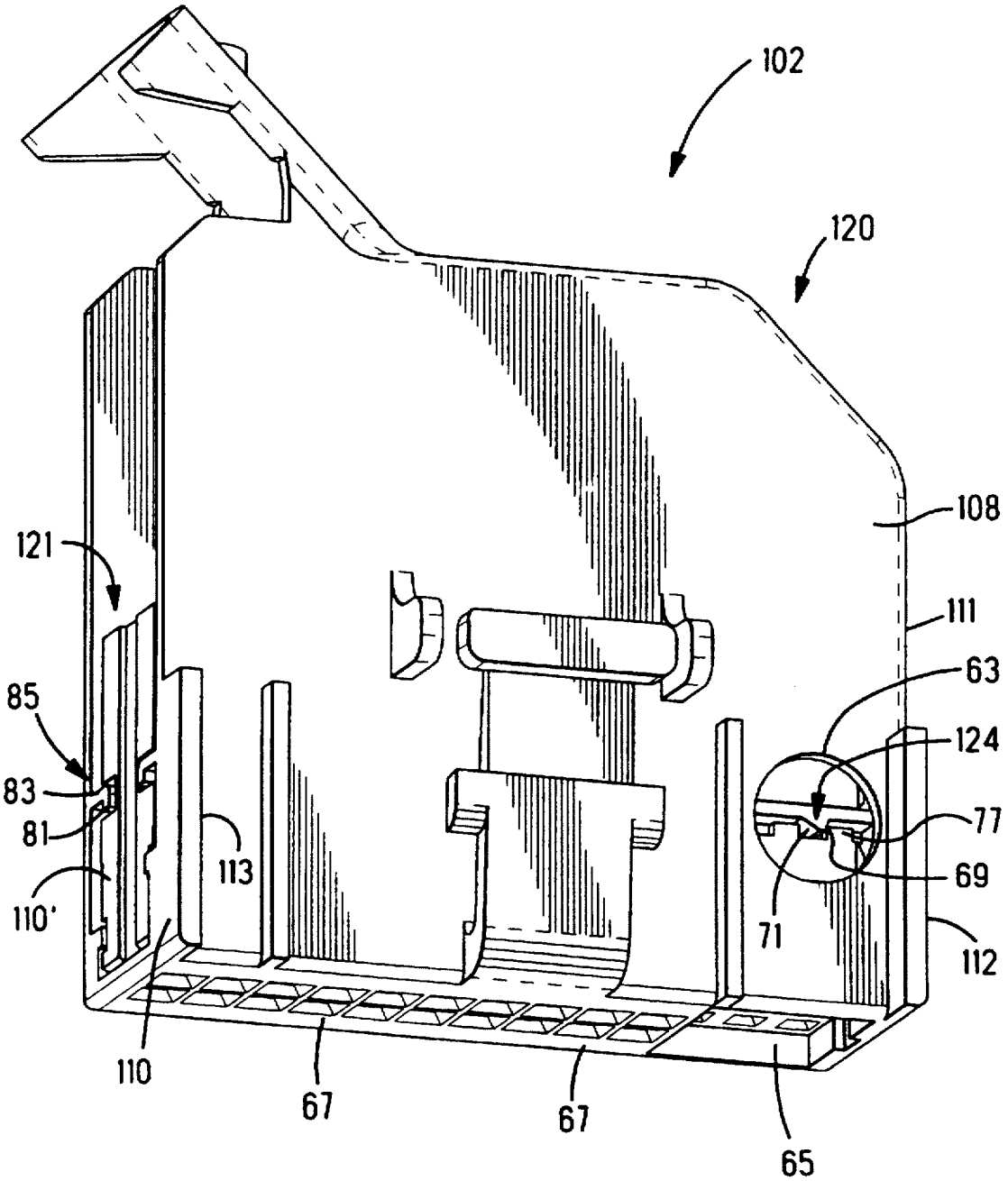
FIG. 7 is a view similar to that of FIG. 6 with the housings fully assembled.
Figure 8:
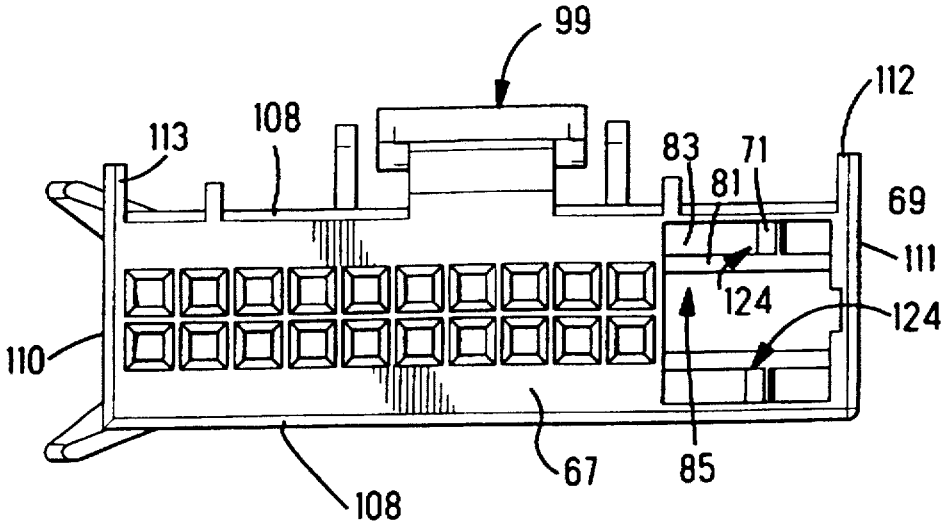
FIG. 8 is a plan view of the mating face of the assembly of FIG. 5.
Figure 9:
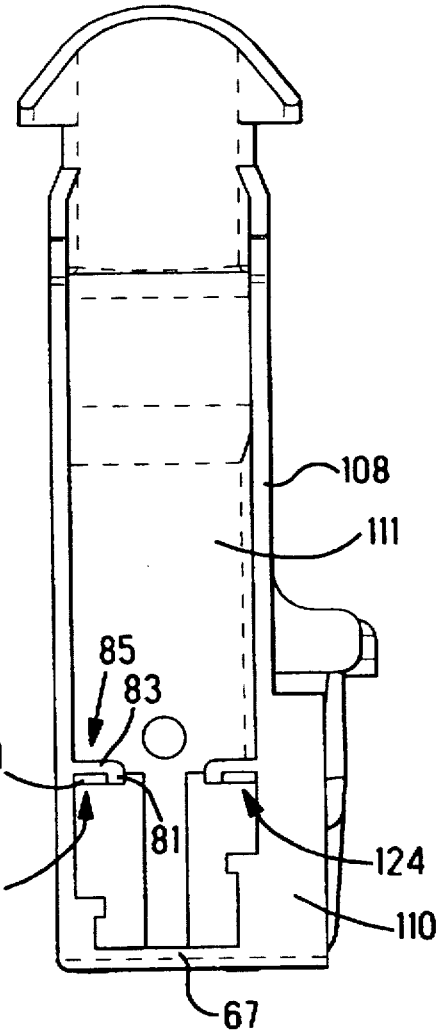
FIG. 9 is an end view of the assembly of FIG. 7.

FIG. 7 shows the socket housing in a fully latched (fully assembled) position within the surrounding housing whereby the latching protrusion 124 has engaged the first wall portion 77. The latching protrusion 124 is provided with a leading end surface 71 that is tapered for smooth ramping over the socket housing tooth 77, and a rearward locking shoulder 69 is provided with an almost vertical but slightly angled locking surface 69. The slight angle or taper 69 enables removal of the socket housing 121 from the surrounding housing when a sufficient force is exerted.

To simplify injection moulding of the protrusion 124, a portion of the mating end wall 67 of the surrounding housing can be removed at 65, or a hole 63 through the surrounding housing side wall 108 at the position of the protrusion 124 can be provided.

We claim:

1. A connector assembly comprising a trough-shaped accommodating part and a plug part which can be plugged into the latter, where:

the accommodating part has an elongate plug channel which is bounded by relatively long longitudinal side walls and relatively short transverse side walls, the plug part has an essentially rectangular cross-section with longitudinal side surfaces and transverse side surfaces, the plug part consists of a surrounding housing having an opening corresponding to one of the transverse side surfaces and having at least one safety rib thereon, and a socket housing, where the socket housing can be pushed into the surrounding housing through the opening on a transverse side surface, complementary latching elements are provided in the surrounding housing and on the socket housing, for the purpose of latching the socket housing in the surrounding housing once received therein, in the vicinity of the transverse side surfaces, a safety rib extending in the plugging direction is situated on longitudinal side surfaces of the socket housing, in such a way that the width of the plug part with the safety ribs is greater than the central width of the plug channel;

complementary safety grooves for accommodating all of the safety ribs are formed in the longitudinal side walls of the accommodating part.

2. The connector assembly according to claim 1, characterized in that the safety ribs on the socket housing have a different width from those on the surrounding housing.

3. A plug part for holding electrical contacts therein and mating these contacts with pins disposed in a plug channel of an accommodating part where the plug channel is defined by longitudinal side walls and transverse side walls, where at least said surrounding housing having at least pair of safety grooves are formed therein, for assuring proper mating occurs, the plug part comprising:

a surrounding housing receivable in the plug channel, the surrounding housing being of shell-like construction with longitudinal side surfaces and transverse side surfaces generally corresponding to the side walls of the accommodating part, where an opening is provided in one of the transverse side surfaces, said surrounding housing having at least one; and a socket housing for positioning the electrical contacts therein that mate with the pins of the accommodating part, the socket part being telescopically received within the surrounding housing by way of the opening where the socket housing and the surrounding housing have complementary latches that engage upon full insertion of the socket housing to retain the socket housing therein, and where at least one safety rib is formed on the socket housing, when the plug part all of said safety ribs being received in the corresponding safety grooves is fully inserted into the accomodating part.

4. The plug part of claim 3 wherein the safety rib formed along the socket housing corresponds to the transverse side surface where the opening is formed.

5. The plug part of claim 3, wherein the safety ribs are of different configuration, thereby assuring proper polarization.

* * * * *